US005592750A

United States Patent [19]

Eichten

[11] Patent Number: 5,592,750

[45] Date of Patent: Jan. 14, 1997

[54] PORTABLE CLOTHING AND EQUIPMENT DRIER

[76] Inventor: Gerard Eichten, 3101 Selkirk Dr., Burnsville, Minn. 55337

[21] Appl. No.: 526,377

[22] Filed: Sep. 11, 1995

[51] Int. Cl.[6] ..... F26B 25/00

[52] U.S. Cl. ..... 34/104; 34/106; 223/70

[58] Field of Search ..... 34/60, 104, 106, 34/168, 177, 210, 222, 224; D32/58, 59; 223/51, 70, 73, 76

[56] References Cited

U.S. PATENT DOCUMENTS

| | | | |
|---|---|---|---|
| 2,804,854 | 6/1937 | McCarthy | D32/58 X |
| 4,198,765 | 4/1980 | Miyamae | 34/104 |
| 5,175,944 | 1/1993 | Fruehauf | 34/60 X |
| 5,199,188 | 4/1993 | Franz | 34/104 X |
| 5,249,369 | 10/1993 | Mallet | 34/104 X |
| 5,287,636 | 2/1994 | Lafluer et al. | 34/104 |
| 5,369,892 | 12/1994 | Dhaemers | 34/275 |
| 5,377,849 | 1/1995 | Martin | 211/13 |
| 5,406,717 | 4/1995 | Dofka | 34/104 |
| 5,412,928 | 5/1995 | Reithel | 34/104 |
| 5,469,635 | 11/1995 | Lamontagne et al. | 34/104 |

FOREIGN PATENT DOCUMENTS 2247514 4/1992 United Kingdom .

*Primary Examiner*—John M. Sollecito
*Assistant Examiner*—Steve Gravini
*Attorney, Agent, or Firm*—Philip G. Alden

[57] ABSTRACT

A drier for articles of clothing including a suitcase-like container having a storage section and an equipment section divided by a base plate. A plurality of conduit members are initially stored in the storage section, and can be removed and selectively assembled into various rack configurations on which articles of clothing may be hung or drying. The conduit members are assembled into one or more racks that are mounted on the base plate in communication with an equal number of conduit openings. A blower and heater disposed within the equipment section draw air through an air inlet, heat that air, and force it through the conduit openings and upwardly through the conduit members. The heated air is expelled through a multiplicity of air outlet apertures disposed within the articles of clothing being dried. A fragrance dispenser operating in conjunction with the blower can uniformly dispense a deodorizer or preferred scent throughout the articles of clothing.

9 Claims, 3 Drawing Sheets

PORTABLE CLOTHING AND EQUIPMENT DRIER

BACKGROUND OF THE INVENTION

1. Field of the Invention

This invention relates to dryers for clothing and equipment and, more particularly, to dryers which are compact, portable, and easily assembled and disassembled into a carrying case.

2. Description of the Prior Art

It is the nature of many sports teams to compete with teams from other cities or regions, wherein the demands of such competition require teams to periodically be away from their home towns either overnight or for several days at a time. During many such outings it is desirable to transport a portable drier so that dampened clothing, shoes, and other athletic gear may be dried and freshened, particularly where laundry facilities are not readily available.

Dryers of the prior art have their limitations and do not satisfactorily meet the needs of traveling athletes. Conventional stationary dryers include either electric or gas heating elements, a motor-driven drum, and a means for circulating and exhausting forced air which is used for drying. Some dryers may include a means for dispensing fragrances; however, fragrances are more typically included in fabric softeners or antistatic sheets which may be placed into the drum along with clothing to be dried. One example of a conventional drier designed accommodate the particular needs of athletic clothing and equipment is the invention disclosed in U.S. Pat. No. 5,369,892 to Dhaemers. Dhaemers '892 discloses a drier which forces heated air around and through clothing and equipment placed within. The Dhaemers '892 design combines drying and mixing chambers, heating elements, and ultraviolet emitters, yet has no rotatable drum. Whereas the Dhaemers '892 invention is particularly well suited for athletic clothing and equipment, all embodiments of this invention are of considerable size and weight. One embodiment of the Dhaemers '892 design which is portable has the essential characteristics of its stationery counterparts; however, it is not designed to be assembled, disassembled, and transported easily by a person who needs to transport travel bags and other articles as well.

An easily transportable drier is disclosed in United Kingdom Patent No. 2,247,514A to Chung et al. The Chung '514 design includes a collapsible housing, an air inlet which accepts the air outlet of an ordinary hair drier, and a means for hanging or holding small articles to be dried. While the Chung '514 invention may meet the needs of those who travel occasionally, there are characteristics which limit its use for athletic clothing and equipment. First, this design is reliant upon an external device, a hair drier, for airflow and heat, a device which is not optimally designed for the drying of clothes. Second, this design accommodates small articles such as socks and the like, but does not easily accept larger articles of clothing or pieces of equipment.

A sports equipment rack is disclosed in U.S. Pat. No. 5,377,849 to Martin. The Martin '849 invention comprises tubular structures which are designed to display and dry sports clothing and equipment. However, the Martin '849 invention is limited in the sense that it lacks both a heating element and forced airflow around and through the members, features which, if present, beneficially reduce drying times. Also, the Martin '849 invention is not designed to assemble and disassemble for traveling.

The desired drier is low in manufacturing cost, self-contained, lightweight, easy to carry, easy to assemble and disassemble, and capable of storing, drying, and deodorizing a variety of athletic clothing and related equipment.

SUMMARY OF THE INVENTION

It is therefore one object of this invention to provide a clothing and equipment drier which is disassembled and stored in a carrying case, and is completely self-contained for transportation.

Another object of this invention is to provide a portable clothing and equipment drier which is lightweight, compact, efficient, easily used, attractive, quiet, and easily carried by a single person.

Another object of this invention is to provide a device which, when properly used, promotes proper maintenance of clothing and equipment, thereby extending their useful life.

Another object of this invention is to provide a portable clothing and equipment drier having racks upon which articles may be hung, dried, and stored, with the rack providing an organizer function to promote a routine manner for handling the articles to make sure they are accounted for and to quickly identify articles that may have been forgotten or lost at another location.

Another object of this invention is to provide a clothing and equipment drier which enables forced air to be directed through a plurality of conduits into the interior of the articles of clothing rather than just the ambient air surrounding the clothing, the conduits serving as racks through which forced air is applied directly to the articles contained thereon to ensure that the air is distributed uniformly throughout the articles to ensure complete and rapid drying.

Another object of this invention is to provide a portable clothing and equipment drier which improves drying times through an optional heating element which is placed in line with a blower.

Another object of this invention is to provide a portable clothing and equipment drier having an optional fragrance dispensing means, which may be used to uniformly dispense a deodorizing compound throughout the articles of clothing, or alternately a specific scent such as earth scent or buck scent when hunting apparel is being stored or dried.

Briefly described, the drier of this invention includes a suitcase-like container having a storage section and an equipment section divided by a base plate. A plurality of conduit members are initially stored in the storage section, and can be removed and selectively assembled into various rack configurations on which articles of clothing may be hung or drying. The conduit members are assembled into one or more racks that are mounted on the base plate in communication with an equal number of conduit openings. A blower and heater disposed within the equipment section draw air through an air inlet, heat that air, and force it through the conduit openings and upwardly through the conduit members. The heated air is expelled through a multiplicity of air outlet apertures disposed within the articles of clothing being dried. Selective control is provided over the blower and heater, and a fragrance dispenser may be mounted on the base plate so as to cooperate with the drier to dispense a deodorizer or scented compound throughout the articles of clothing.

Other objects and advantages of the invention will appear during the course of the following description. Whereas inspiration for the present invention stems from needs of the traveling athletes and their teams, this invention is not so limited. The scope of this invention extends to every application wherein similar objectives can be realized.

DESCRIPTION OF THE PREFERRED EMBODIMENTS

Figure 1:
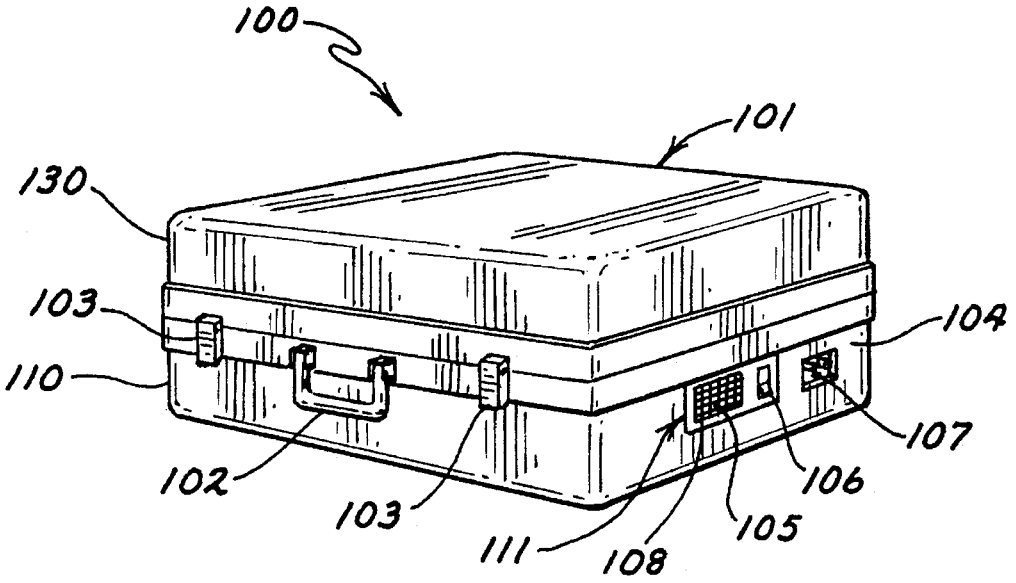
FIG. 1 depicts an outside view of one embodiment of a container for the inventive drier.

The drier of this invention is shown in FIGS. 1–4, and referenced generally therein by the reference numeral 100.

FIG. 1 illustrates an outer view of one preferred embodiment 100 for the present inventive drier including container 101 which also serves as carrying case, handle 102, latches 103, and, on the side panel of outer wall 104, and air inlet 105, control switch 106, and a recessed, male connector 107 for an external A/C power cord. A protective shield 108 is disposed on the outer wall 104 to cover the air inlet 105. Disposed within the lower portion of container 101 is equipment section 110. Disposed within the upper portion of container 101 is the storage section 130. The rear of carrying case 101 includes hinge members (not shown) to facilitate the opening and closing of carrying case 101 and ease of access to the equipment section 110 and storage section 130.

Figure 2:
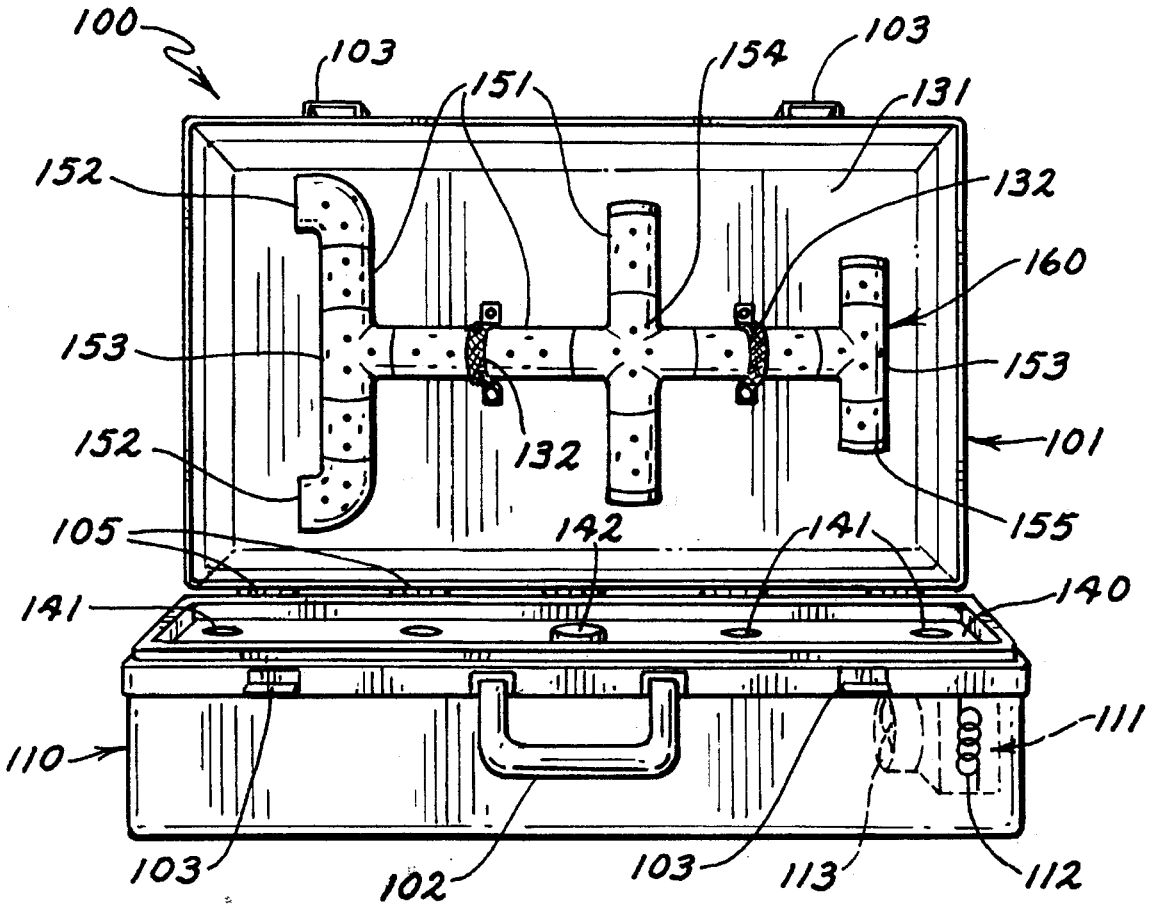
FIG. 2 depicts the front view of one embodiment of an opened storage container.

FIG. 2 depicts a frontal view of an opened container 101, exposing storage section 130 and a portion of the equipment section 110. Disposed within equipment section 130 is a compartment 111 containing control switch 107, an optional heating element 112 and blower 113. Also depicted is the base plate 140 through which several conduit openings 141 are strategically placed. Also disposed within the base plate 140 is the fragrance dispenser 142, placed in a manner which is easily accessible through the opened container 101 in order that fragrances contained therein may be replenished when necessary. Compounds that may be utilized in the fragrance dispense include deodorizers for daily apparel or sports apparel, or scents such as earth scent or buck scent for hunting apparel.

Removably strapped to the upper wall 131 of the storage section 130 is a rack assembly 160 comprised of several straight conduit members 151, two elbow-shaped (or angled) conduit coupling members 152, two "T"-shaped (or straight) conduit coupling members 153, one 4-way coupling member 154, and several end caps 155 sealing the ends of the conduit members 151 and 152. Straps 132 may be made either of cloth or another suitable material and removably attached to the upper wall 131 of the storage section 130 using hook and loop or other convenient attachment means. For the purpose of clarity of this drawing, only the rack assembly 160 is shown to be stored within storage section 130; however, please note that said storage section 130 is of adequate size to receive and store other conduit members which are not depicted in FIG. 2.

Figure 3:
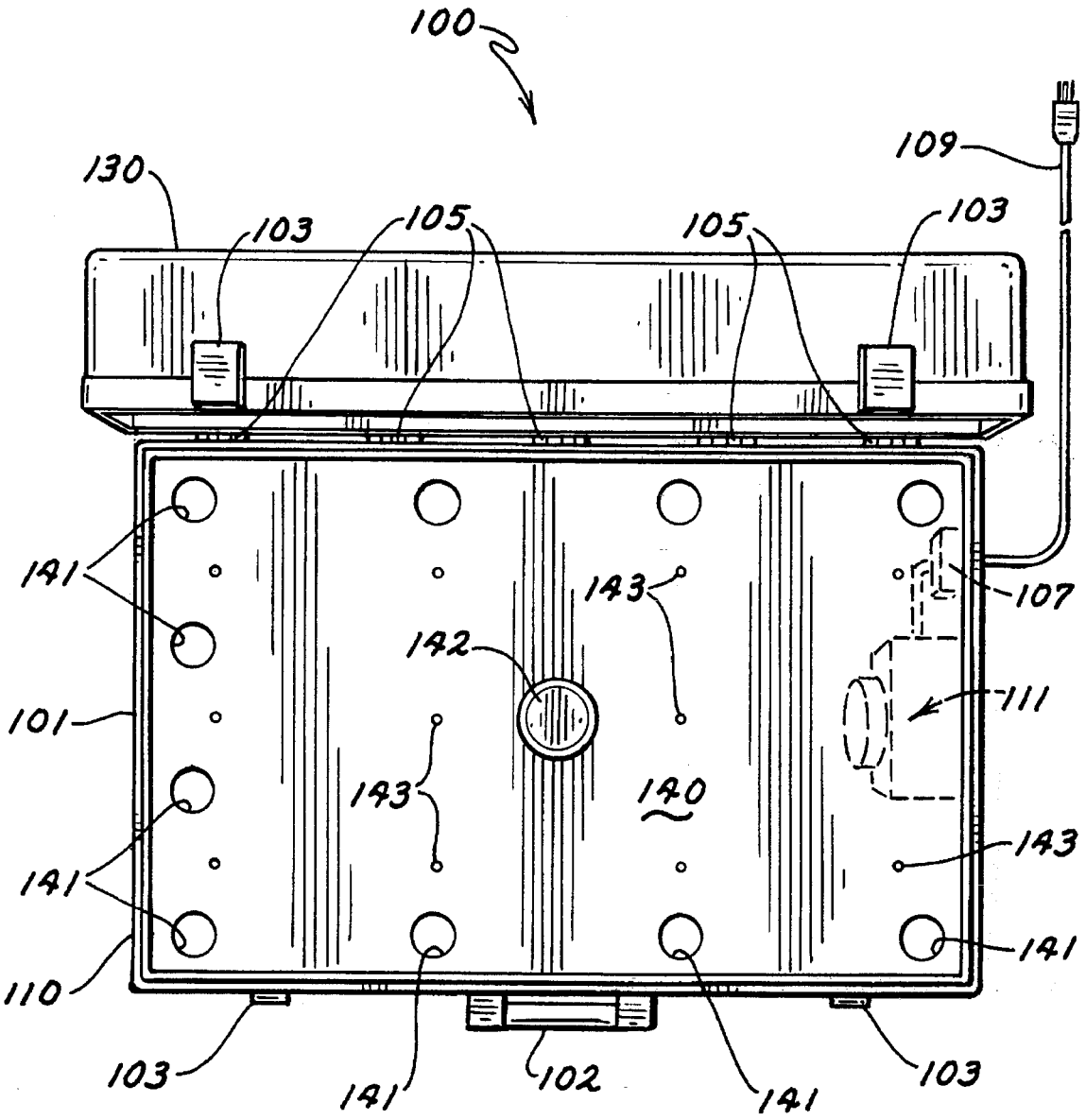
FIG. 3 is the top view of the embodiment shown in FIG. 2.

FIG. 3 depicts a top-down view of the opened container 101, showing the front of the storage section 130 and exposing the base plate 140 in greater detail. It can be seen that the base plate 140 is of sufficient size and so received within container 101 such that air can only flow through the desired conduit openings 141 and small airflow openings 143. Several conduit openings 141 are arranged to receive several conduit members (not shown). It can be seen that the base plate 140 provides a foundation for receiving several conduit members, and the layout of said conduit openings 141 is such that the arrangement of conduit members provides adequate spacing for the drying of clothing and equipment placed thereon. The several small airflow openings 143 are so arranged to further facilitate the circulation of forced air around and through the articles to be dried. Also shown is fragrance dispenser 142, handle 102, latches 103, and hinges 105 for opening and closing the container 101. Also depicted is the location of compartment 111 which contains the blower 113, control switch 106, and an optional heating element 112. An external A/C power cord 109 is also shown.

Figure 4:
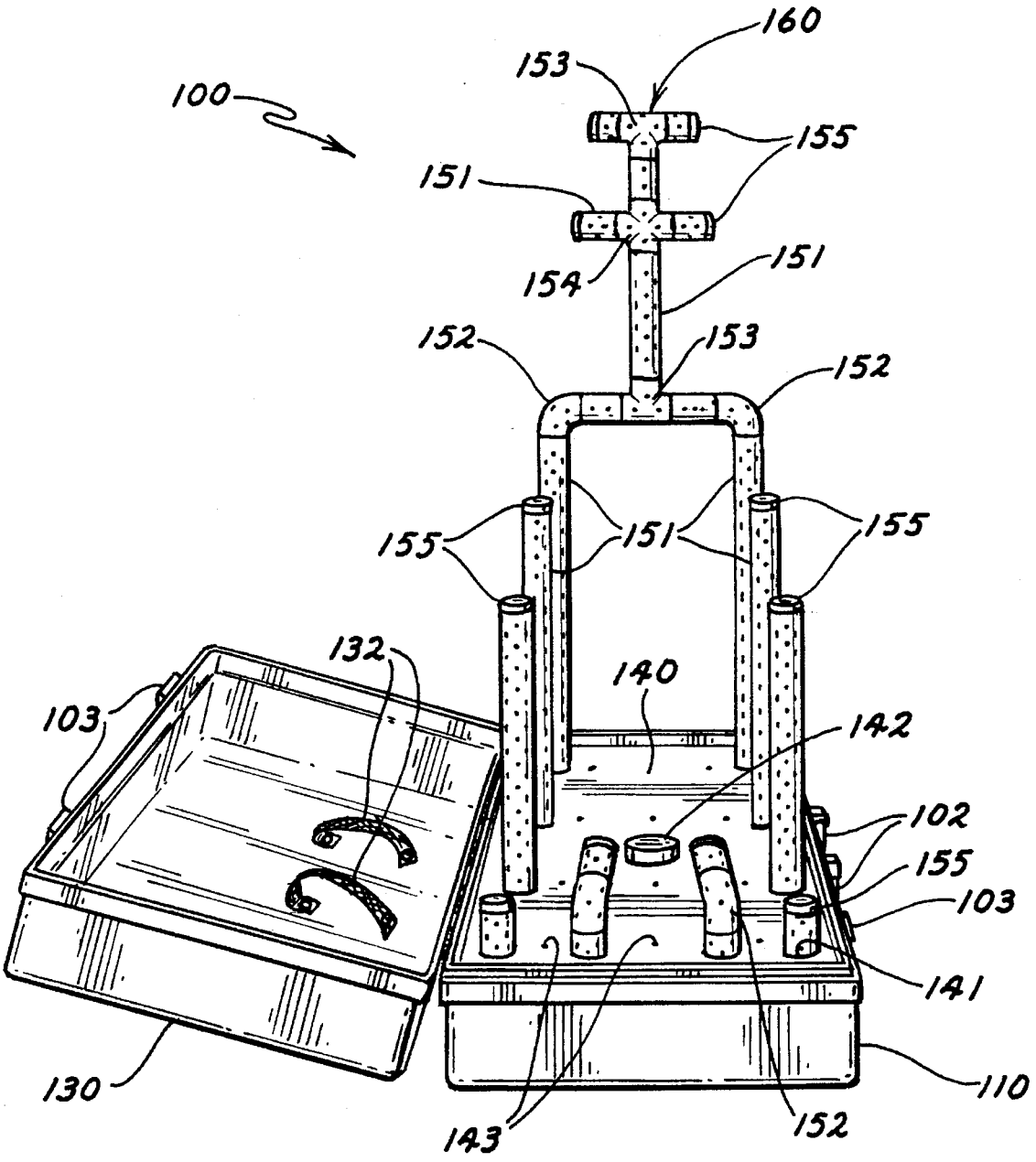
FIG. 4 depicts the inventive drier with its container opened and conduit members assembled in one preferred embodiment.

FIG. 4 depicts the preferred embodiment 100 fully assembled, with several conduit members 151 and rack assembly 160 properly received within the conduit openings 141 of the base plate 140. One problem is that conduit members 151 must be received within the conduit openings 141 in a manner such that the conduit members 151 stand erect; however, if the conduit members 151 are lowered too far within the equipment section 110, airflow will be overly restricted. The preferred solution is to provide airflow slots along the portions of conduit members 151 which are lowered into conduit openings 141. Another solution is to bevel the conduit openings 141 and correspondingly taper conduit members 151 so the conduit members stand erect when received and airflow is not overly restricted. Also, it can be seen that air outlet openings 152 are interspersed throughout conduit members 151 and rack assembly 160 in order to facilitate the circulation of forced air around and through articles to be dried. It can also be seen that caps 153 may be placed at the ends of conduit members 151, thereby further channeling airflow through the air outlet openings 152.

It can be seen that rack assembly 160 is designed to accommodate the drying of articles such as helmets, face masks, caps, upper and lower garments, undergarments, pads, etc. Conduit members 151 may likewise be arranged to accommodate articles such as shoes, boots, gloves, upper and lower garments, etc.

Whereas the shapes of conduit members 151, rack assembly 160, and their related elements are depicted as tubular, this invention is not so limiting. For example, conduit members may be rectangular in cross section.

When the drier 100 is properly assembled and articles to be dried are properly placed thereon, the user operates the drier 100 by properly connecting the AC power cord 109 to an AC power source and setting the control switch. Through electric circuitry disposed within compartment 111, power is applied to the blower 113 and, if selected, the optional heating element 112. Input air then flows through the air inlet 105 where it may be heated by heating element 112. Airflow is propelled through the blades of blower 113 where air is then forced into the equipment section 110. Forced air then fills the equipment section 110, circulating within said equipment section 110 and coming in contact with fragrance which may be dispensed, at the option of the user, by fragrance dispenser 142. Forced air then flows through conduit openings and small airflow openings 143, where air is forced around and through articles to be dried via air outlet openings 152 disposed within conduit members 151 and rack assembly 160, and via small airflow openings 143.

Within a reasonable amount of time, and depending upon the airflow rating of the blower 113 and the heat output rating of heating element 112, dampened articles placed upon the inventive drier 100 will become dry. Then, power to the drier may be shut-off at control switch 106 either at the discretion of the user or through an optional timing mechanism which may be disposed with said compartment 111 and connected to control switch 106. In the preferred embodiment, the blower 113 airflow rating ranges between one hundred and one hundred ten cubic feet per minute (100–110 cfm).

Whenever it is desired that fewer articles are to be dried than may be placed on conduit members 151 and rack assembly 160, it is preferable to cap some of the conduit openings 151 rather than installing all of the conduit members 151. In this manner forced air is more efficiently directed to the articles to be dried.

In the preferred embodiment, electric circuitry includes an easily accessible fuse or circuit breaker sized according to the current ratings of the blower 113 and optional heating element 112.

This invention has been described herein in considerable detail in order to comply with the Patent Statutes and to provide those skilled in the art with the information needed to construct and use such specialized components as are required. However, while a particular embodiment of the present invention has been described herein in detail, it is to be understood that various alterations, modifications and substitutions can be made therein without departing from the spirit and scope of the present invention, as defined in the following.

What is claimed is:

1. A portable drier for use in drying articles of clothing, said portable drier comprising:

a) a container having an outer wall, a storage section, and an equipment section, a base plate, an electric circuit, and a control, said storage section and said equipment section being disposed within said container, said base plate having a plurality of conduit openings, said base plate further being disposed within said container so as to separate said equipment section from said storage section;

b) a blower disposed within said equipment section, said blower having a blower inlet and a blower outlet, said base plate further disposed to enable the flow of forced air from said blower outlet to said conduit openings;

c) a plurality of conduit members each having a plurality of air outlet openings, the plurality of conduit members initially being disposed within the storage section of the container and further capable of being assembled into at least one rack and mounted in position relative to the conduit openings of the base plate such that the plurality of conduit members direct the forced air from the blower to the plurality of air outlet openings such that the forced air is expelled within the articles of clothing disposed on the at least one rack; and d) an air inlet extending through the container and communicating with the equipment section and the blower inlet, whereby air is drawn through the air inlet into the blower disposed within the equipment section, and is forced by the blower through the conduit openings of the base plate and through the conduit members, and is expelled through the air outlet openings within the articles of closing to thereby dry the articles of clothing.

2. The drier of claim 1 wherein the at least one rack further comprises:

at least one angular coupling member for mounting at least one of the plurality of conduit members at an angle relative to the base plate.

3. The drier of claim 1 wherein the at least one rack further comprises:

at least one angular coupling member for mounting at least one of the plurality of conduit members at an angle relative to another one of the plurality of conduit members.

4. The drier of claim 1 wherein a compound is applied to the articles of clothing during drying, the drier further comprising:

a fragrance dispenser, the fragrance dispenser being disposed within said equipment section and operatively associated with the blower such that the fragrance dispenser dispenses the compound applied to the articles of clothing during drying.

5. The drier of claim 4 wherein the articles of clothing are sports apparel and the compound is a deodorizer.

6. The drier of claim 4 wherein the articles of clothing are hunting apparel and the compound is a scent.

7. The drier of claim 1 further comprising:

a heating element, the heating element being disposed within said equipment section and operatively connected such that the air drawn in through the air inlet and forced through the conduit openings is heated.

8. The drier of claim 7 wherein the drier is electrically connected to an external power source, and wherein the control provides electrical control for the heating element, and wherein the electric circuit provides electrical connectivity between the external power source, the control means, and the heating element.

9. The drier of claim 1 wherein the drier is electrically connected to an external power source, and wherein the control provides electrical control for the blower, and wherein the electric circuit provides electrical connectivity between the external power source, the control means, and the blower.

* * * * *